US006581787B2

(12) United States Patent
Barrett et al.

(10) Patent No.: US 6,581,787 B2
(45) **Date of Patent: *Jun. 24, 2003**

(54) MODULAR GRAVITY FEED DISPENSER UNIT

(75) Inventors: Ricklef E. Barrett, Elkhart, IN (US); Martin L. De Land, Corona, CA (US)

(73) Assignee: L&P Property Management Company, South Gate, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/232,212

(22) Filed: Aug. 29, 2002

(65) Prior Publication Data

US 2003/0000899 A1 Jan. 2, 2003

Related U.S. Application Data

(63) Continuation of application No. 09/645,018, filed on Aug. 23, 2000, now Pat. No. 6,494,328.

(51) Int. Cl.[7] ..... A47F 1/08
(52) U.S. Cl. ..... 211/59.2
(58) Field of Search ..... 211/59.2, 191, 211/192

(56) References Cited

U.S. PATENT DOCUMENTS

| | | | | |
|---|---|---|---|---|
| 2,692,053 | A | | 10/1954 | Calhoun et al. |
| 2,957,700 | A | | 10/1960 | Beaurline |
| 2,965,242 | A | | 12/1960 | Grotke |
| 2,991,889 | A | | 7/1961 | Levy et al. |
| 3,160,281 | A | | 12/1964 | Ruhnke |
| 3,184,104 | A | * | 5/1965 | DeDomenico et al. ..... 221/92 |
| 3,194,433 | A | | 7/1965 | Heselov |
| 3,405,985 | A | | 10/1968 | Higer |
| 3,502,292 | A | | 3/1970 | Yoder |
| 3,750,893 | A | | 8/1973 | Kempler |
| 3,776,419 | A | * | 12/1973 | Zinkgraf et al. ..... 312/35 |
| 3,971,477 | A | | 7/1976 | Bruderly et al. |
| 4,046,083 | A | | 9/1977 | Murdoch et al. |
| 4,068,855 | A | | 1/1978 | Hackett |
| 4,127,196 | A | | 11/1978 | Boucher |
| 4,199,069 | A | | 4/1980 | Talarico |
| 4,318,577 | A | | 3/1982 | Vona |
| 4,479,583 | A | | 10/1984 | Franklin et al. |
| 4,693,383 | A | | 9/1987 | Fenwick |
| 4,790,707 | A | * | 12/1988 | Magretta et al. ..... 211/187 |
| 4,801,182 | A | | 1/1989 | Metcalfe et al. |
| 4,829,977 | A | | 5/1989 | Valentine |
| 4,919,282 | A | | 4/1990 | Duff et al. |
| 5,127,341 | A | | 7/1992 | Wiklund |
| 5,160,051 | A | * | 11/1992 | Bustos ..... 211/59.2 |
| 5,255,803 | A | | 10/1993 | Pavone et al. |
| 5,361,937 | A | | 11/1994 | Weise |
| 5,407,262 | A | | 4/1995 | Christian et al. |
| 5,529,192 | A | | 6/1996 | Conen et al. |
| 5,533,646 | A | | 7/1996 | Dildine |
| 5,566,844 | A | | 10/1996 | Bernardin |
| 5,573,124 | A | | 11/1996 | Frost |
| 5,605,238 | A | | 2/1997 | Jacobs |
| 5,607,070 | A | | 3/1997 | Hellyer |
| 5,697,507 | A | | 12/1997 | Blass |
| 5,700,075 | A | | 12/1997 | Perone |
| 5,722,544 | A | | 3/1998 | Williams |
| 5,855,422 | A | | 1/1999 | Naef |
| 5,918,750 | A | | 7/1999 | Jackson |

* cited by examiner

*Primary Examiner*—Daniel P. Stodola
*Assistant Examiner*—Erica B Harris
(74) *Attorney, Agent, or Firm*—Michael Best & Friedrich LLC

(57) ABSTRACT

A modular system is provided for mounting a gravity feed dispenser that allows one or more fixtures to be mounted in front of, and in working relationship with, the dispenser. The gravity feed dispenser is mounted on a support structure in such a way that other fixtures such shelving, hangers, rods, or other storage and display fixtures can be mounted in front of the dispenser in a number of different configurations. A workstation featuring one or more gravity feed dispensers is provided by mounting a work area and shelves in front of and in working relationship with the dispensers.

14 Claims, 6 Drawing Sheets

MODULAR GRAVITY FEED DISPENSER UNIT

This application is a continuation of application Ser. No. 09/645,018 filed Aug. 23, 2000, granted as U.S. Pat. No. 6,494,328 B1.

FIELD OF THE INVENTION

This invention relates generally to modular display systems and workstations and, more particularly, to modular display systems and workstations featuring a gravity feed dispenser.

BACKGROUND AND SUMMARY OF THE INVENTION

Gravity feed dispensers are known in the art. Such dispensers may be used to store and dispense a wide variety of items, such as empty containers, bottles or vials, and find use in a wide variety of environments. In general, such dispensers comprise one or more side-by-side elongate, generally vertical chutes, each having an opening at its top end for loading and a dispensing receptacle that opens at the bottom end of the chute. Items to be stored in the dispenser are loaded into the chute through the top opening and are thereby stacked within the chute, with the bottommost item or items being available for removal from the dispensing receptacle on a first-in-first-out basis. When an item is removed from the dispenser via the dispensing receptacle, the items stored above the removed item will move downward under the force of gravity and refill the dispensing receptacle. In this manner, so long as there is a supply of items within the dispenser, the dispensing receptacle is automatically refilled whenever an item is removed. Examples of prior art gravity feed dispensers are disclosed in U.S. Pat. No. 2,692,053 (Calhoun et al.), U.S. Pat. No. 3,194,433 (Heselov), U.S. Pat. No. 4,479,583 (Franklin et al.), and U.S. Pat. No. 5,361,937 (Weise).

Gravity feed dispensers are utilized in a variety of different ways. For example, retailers often use gravity feed dispensers to display merchandise, such as cigarette packages, batteries, candy, or clothespins. (See, for example, U.S. Pat. Nos. 3,194,433 and 5,361,937.) Gravity feed dispensers are also used to store items in a manner that provides convenient access to such items. For example, pharmacists are constantly filling vials with pills and the like when filling prescriptions. Therefore, pharmacists require a steady supply of empty prescription vials of different sizes. To meet this need, pharmacies often store a variety of empty vials (and the caps therefor) in drawers, on shelves and in gravity feed dispensers, giving pharmacists ready access to a supply of vials and caps.

In the prior art, gravity feed dispensers were generally fixed directly to a wall or the front face of a display rack. For example, U.S. Pat. Nos. 4,479,583 and 5,361,937 show gravity feed dispensers which are mounted to a wall for purposes of displaying a variety of items for sale. While such dispensers may present an attractive and easy-to-use sales display, mounting a dispenser in this fashion takes up a considerable amount of valuable space and makes it difficult to mount fixtures such as shelves, racks, hanger rods, storage bins, drawers, hooks and the like in front of the dispenser. Because access to the gravity feed dispenser is typically only required at the top loading opening and bottom dispensing receptacle (so that items can be loaded and removed from the dispenser), the space taken up by the height of the dispenser between the bottom and top can be considered dead or wasted space in the prior art applications. Thus, in situations where space is at a premium, there is a need for a system for mounting a gravity feed dispenser that allows a variety of fixtures to be mounted in front of the dispenser, yet still allows easy access to the dispenser's top loading opening and bottom dispensing receptacle.

In general, the present invention solves the foregoing shortcomings of conventionally mounted gravity feed dispensers by providing a system for mounting a gravity feed dispenser that allows one or more fixtures to be mounted in front of, and in working relationship with, the dispenser. The invention can therefore be used to create a display or storage device that maximizes space utilization by mounting shelving, hangers, rods, or other storage and display fixtures in front of the dispenser.

Likewise, the invention can also be used to create a workstation featuring one or more gravity feed dispensers by mounting a work area and shelves in front of and in working relationship with the dispensers. Such a workstation is particularly suitable for use in a pharmacy where empty vials (and lids) used for filling prescriptions can be stored in dispensers integrated directly into the pharmacist's workstation, thereby eliminating the need for the pharmacist to leave the workstation to retrieve the necessary empty vials and lids. Such a workstation provides a pharmacist with additional storage and work surfaces in spaces that would otherwise be wasted.

DETAILED DESCRIPTION OF THE INVENTION

Figure 1:
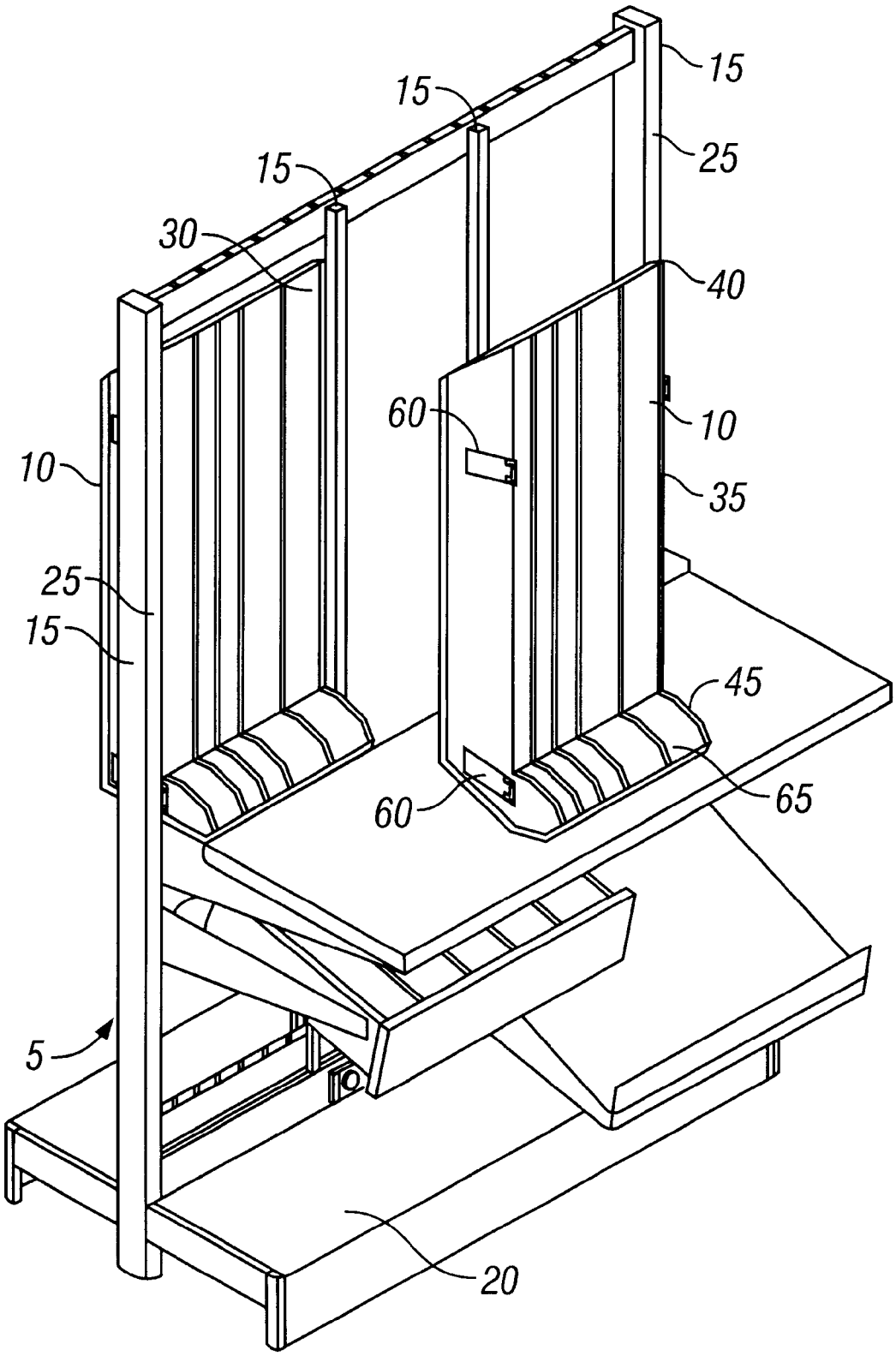
FIG. 1 is a partially exploded perspective view of a first embodiment of the invention.

As shown in FIG. 1, a first embodiment of the present invention comprises a support structure 5 to which one or more gravity feed dispensers 10 are mounted. As is well known in the art, support structure 5 may be designed and configured so that a variety of different fixtures—such as shelves, racks, hanger rods, storage bins, drawers, hooks and the like—can be mounted on the support structure.

Figure 5:
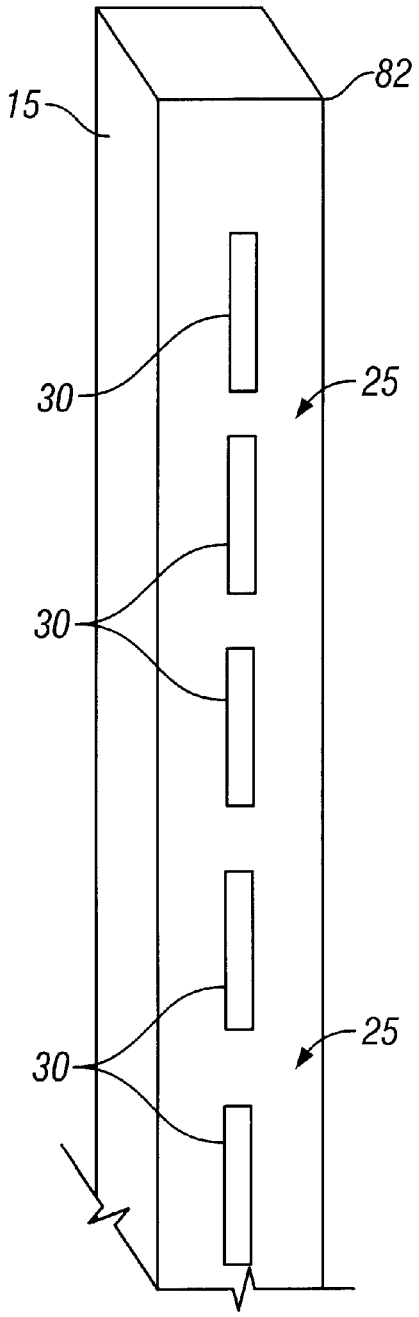
FIG. 5 is a perspective view of a portion of one of the vertical posts shown in FIG. 1.

In the illustrative example shown in FIG. 1, support structure 5 comprises a plurality of vertical standards or posts 15 mounted to a base 20. Vertical posts 15 are aligned on base 20 so that the front surface 25 of each vertical post 15 lies in the same front plane. As best seen in FIG. 5, each vertical post 15 has a front surface 25 featuring a series of vertical slots 30. As described in more detail below, slots 30 are sized and shaped to receive mounting brackets, thereby allowing a variety of different fixtures to be mounted to the vertical posts 15. In a preferred embodiment, the support structure is approximately 84 inches in height, and the base 20 is about 40 inches long, 24 inches deep and 6 inches in height. Preferably, the base 20 is a modular unit so that it can be combined with other like bases to create a row or aisle of display or shelving units.

Support structures of the type illustrated in FIG. 1 (excluding gravity feed dispensers) are well known in the art and need not be described in detail here. Such support structures are commercially available from a number of different sources, including Dann Dee Display Fixtures of Niles, Ill., and Syndicate Systems of Middlebury, Ind. Examples of support structures like that shown in FIG. 1 are disclosed in U.S. Pat. Nos. 2,991,889, 4,046,083, 4,919,282, 5,605,238 and 5,697,507, the teachings of which are incorporated herein by reference. For example, U.S. Pat. No. 2,991,889 shows a support structure comprising a base with slotted vertical posts for mounting shelving and other fixtures in a variety of configurations.

It should be understood that the support structure of FIG. 1 is shown for illustrative purposes only, and is not meant to limit the scope of the present invention. Any type of suitable support structure can be used in the present invention. Likewise, as shown in the prior art patents mentioned above, there are a large variety of gravity feed dispensers known in the art for applications quite different than disclosed here—gravity feed dispenser 10 shown in FIG. 1 is for illustrative purposes only, and is not meant to limit the scope of the present invention.

Figure 3:
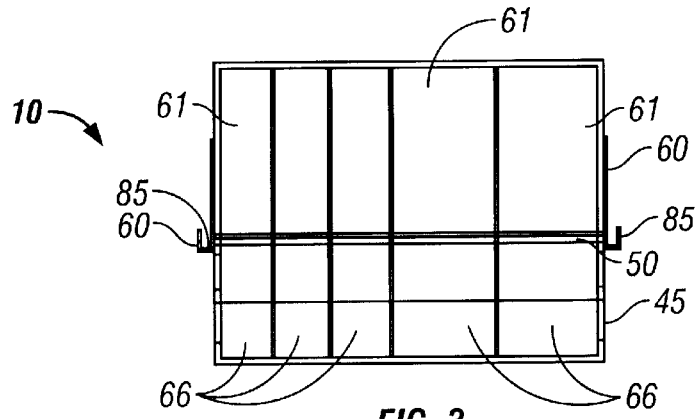
FIG. 3 is a top view of the gravity feed dispenser of FIG. 2.
Figure 2:
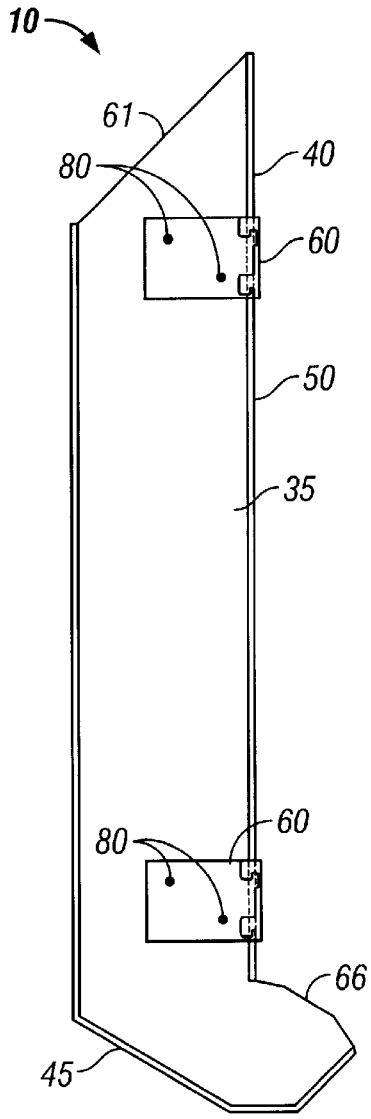
FIG. 2 is side elevation view of one of the gravity feed dispensers shown in FIG. 1.
Figure 4:
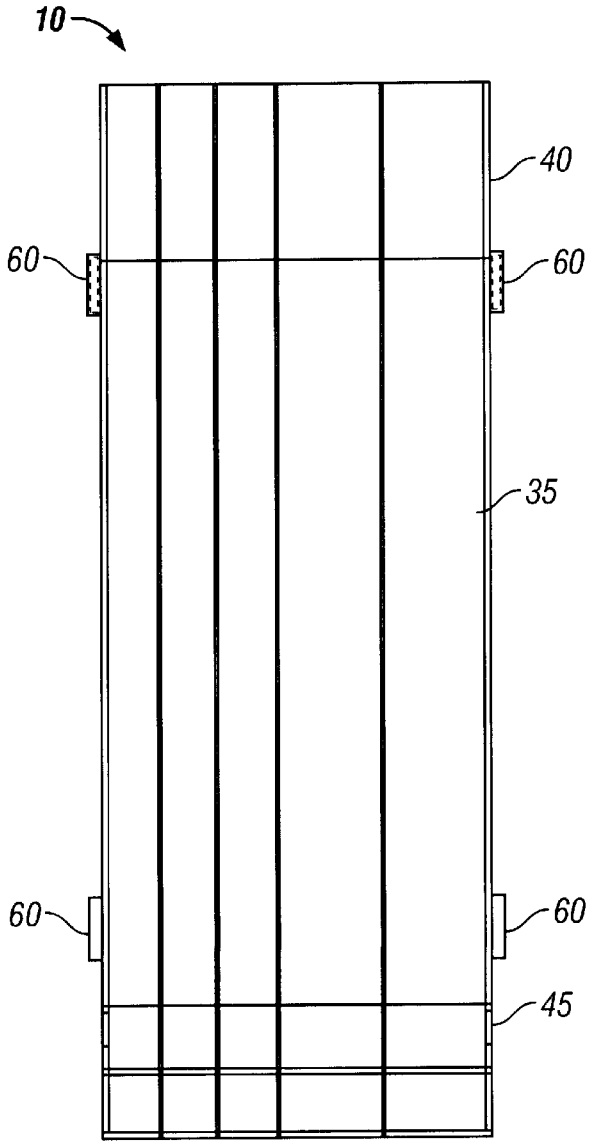
FIG. 4 is a front elevation view of the gravity feed dispenser of FIG. 2.

As best seen in FIGS. 2–4, illustrative gravity feed dispenser 10 comprises one or more side-by-side storage means such as elongate chutes 35, each chute 35 having a top loading end 40, a bottom dispensing receptacle 45, and a front face 50 extending between the loading end 40 and the dispensing receptacle 45. As shown in FIGS. 3–4, the elongate chutes are preferably provided in varying widths so that the dispenser can accommodate a variety of different sized items, such as a variety of different sized and shaped vials and lids (not shown). While the dimensions of the gravity feed dispenser can vary greatly and without restriction depending on the particular application, in a preferred embodiment the dispenser is about 42 inches in height, 14½ inches in width, and 11 inches deep. In a preferred embodiment, the individual chutes 35 are about 6½ inches deep and range in width from about 2 inches to almost 4 inches.

In the embodiment illustrated in FIGS. 1–4, the top loading end 40 of each chute 35 features a loading opening 61 through which items can be loaded into the chute 35. Likewise, each bottom dispensing receptacle 45 features a dispensing opening 66 through which one or more items stored within the dispenser can be removed. In the preferred embodiment of FIGS. 2–4, dispensing receptacle 45 projects outwardly from chute 35 to provide easy access to items stored therein, but this receptacle configuration is not required and a variety of other configurations may be used to fit the needs of different environments.

Figure 11:
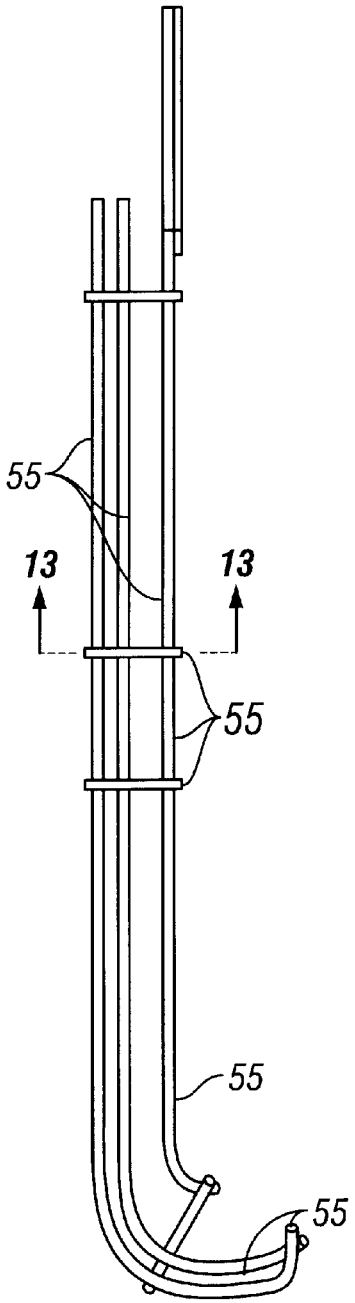
FIG. 11 is a side elevation view of another embodiment of a gravity feed dispenser.
Figure 12:
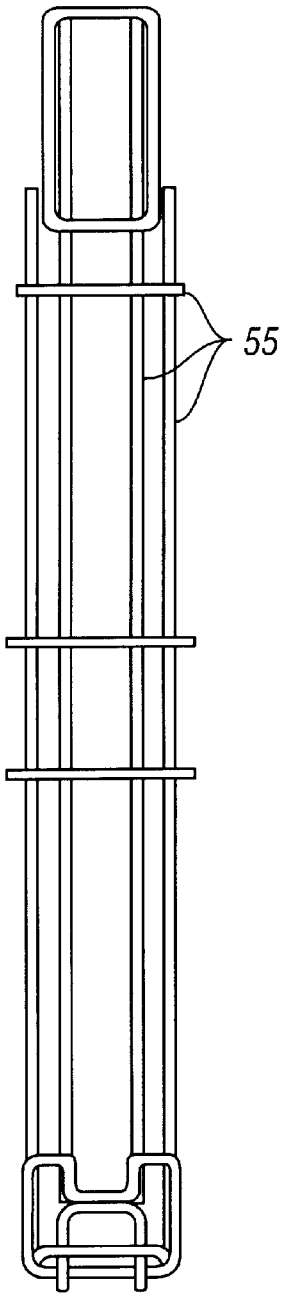
FIG. 12 is a front elevation view of the gravity feed dispenser of FIG. 11.
Figure 13:
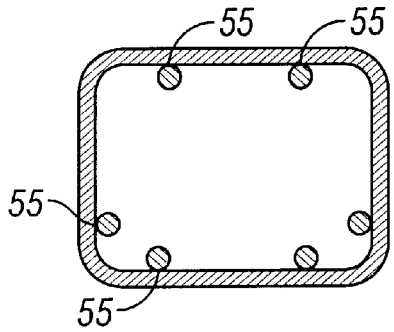
FIG. 13 is a cross-sectional view of the feed dispenser of FIG. 11 taken along line 13—13.

The gravity feed dispenser 10 is preferably made from a clear plastic (so that the contents of the dispenser can be viewed from the outside), but any suitable material can be used. In addition, although the preferred dispenser shown in FIGS. 1–4 is of solid construction (i.e., is made up of a series of solid walls), the dispenser can also be of an open design. For example, an alternate gravity feed dispenser 110 as shown in FIGS. 11–13 and described below comprises a chute defined by wire rods 55, rather than solid walls.

Figure 6:
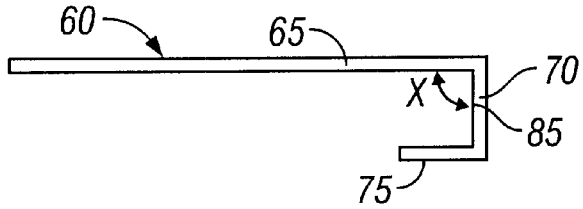
FIG. 6 is a top view of one of the mounting brackets shown in FIG. 1.
Figure 7:
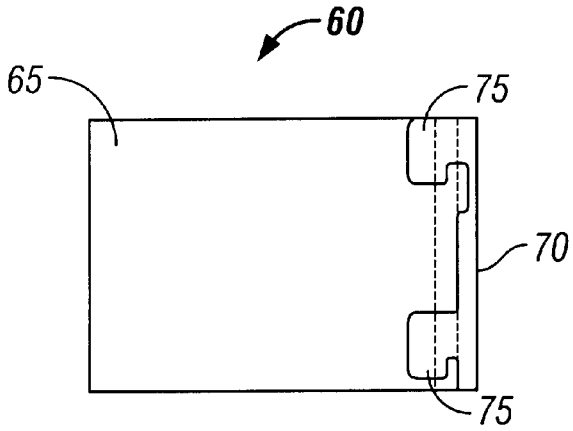
FIG. 7 is a side elevation view of the mounting bracket of FIG. 6.

Returning to the preferred embodiment shown in FIGS. 1–4, gravity feed dispenser 10 further comprises mounting brackets 60 for mounting the dispenser 10 to support structure 5. As best seen in FIGS. 6–7, mounting bracket 60 comprises a generally L-shaped member formed by a side wall 65 and a front wall 70. In a preferred embodiment, the length of the bracket is about 4 inches and the height is about three inches. One or more hooked tongues 75 extend rearwardly from the front wall 70 parallel to, and in the same direction as, the side wall 65. Hooked tongues 75 are sized and shaped to fit within and removably engage vertical slots 30 or other appropriate apertures provided on vertical post 15.

In the preferred embodiment shown in FIGS. 2–4, two mounting brackets 60 are attached on each side of the dispenser 10, one pair near the top and the other pair near the bottom. For illustrative purposes, the side wall 65 of bracket 60 is shown attached to the side of the dispenser 10 by screws 80. However, any suitable means can be used to attach mounting brackets 60 to the dispenser 10.

Figure 8:
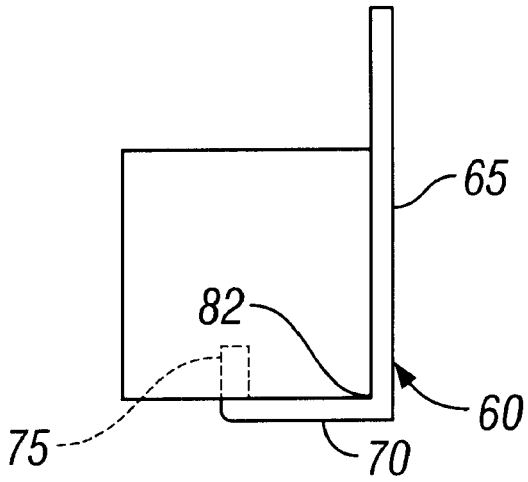
FIG. 8 is a top view of the mounting bracket of FIG. 6 mounted on the vertical post of FIG. 5.
Figure 9:
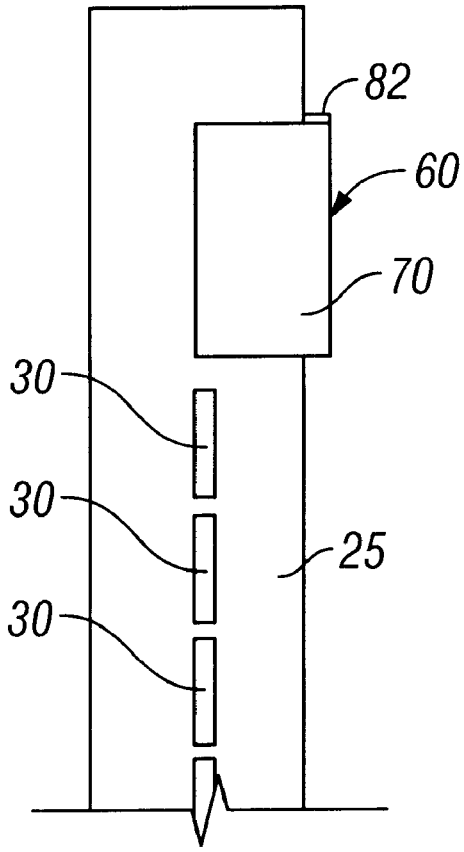
FIG. 9 is a partial front elevation view of the combination of FIG. 8.

As best shown in FIGS. 8–9, mounting bracket 60 is sized and shaped to fit around a corner 82 of the post 15 when the bracket tongues 75 are inserted into the slots 30 on the front surface 25 of vertical post 15. The corner 82 of vertical post 15 fits within the inner corner x (see FIG. 6) formed by side wall 65 and front wall 70 of bracket 60. Thus, when mounting bracket 60 engages the vertical post 15, the inner surface 85 of the front wall 70 of the bracket is juxtaposed against the front surface 25 of the post, and side wall 65 extends along the side wall of the post.

The mounting brackets 60 should be secured to the dispenser 10 so that when the dispenser is mounted to the vertical posts 15, shelving or other fixtures can be secured to the posts in front of the dispenser. Preferably, each mounting bracket 60 is positioned on the gravity feed dispenser 10 so that the inner surface 85 of the bracket front wall 70 is aligned with the front face 50 of the dispenser (see FIGS. 2 and 3). Accordingly, when the dispenser 10 is mounted to the support structure 5 via mounting brackets 60, as shown in FIG. 1, the front face 50 of the dispenser is flush with, and does not extend forward of, the front surfaces 25 of vertical posts 15.

This positioning of the gravity feed dispenser 10 on support structure 5 makes it easy to mount one or more additional fixtures—such as shelves, racks, hanger rods, storage bins, drawers, hooks and the like—in front of or in working relationship with the dispenser 10. For example, in the embodiment shown in FIG. 10, a number of fixtures—including shelves 90 and slat wall section 92—are mounted in front of the gravity feed dispensers 10. These fixtures can be mounted to the support structure 5 by any suitable means known in the art, such as, for example, the conventional mounting brackets 95 shown in FIG. 10, which brackets are sized and shaped to engage the elongate slots 30 of vertical posts 15.

Figure 10:
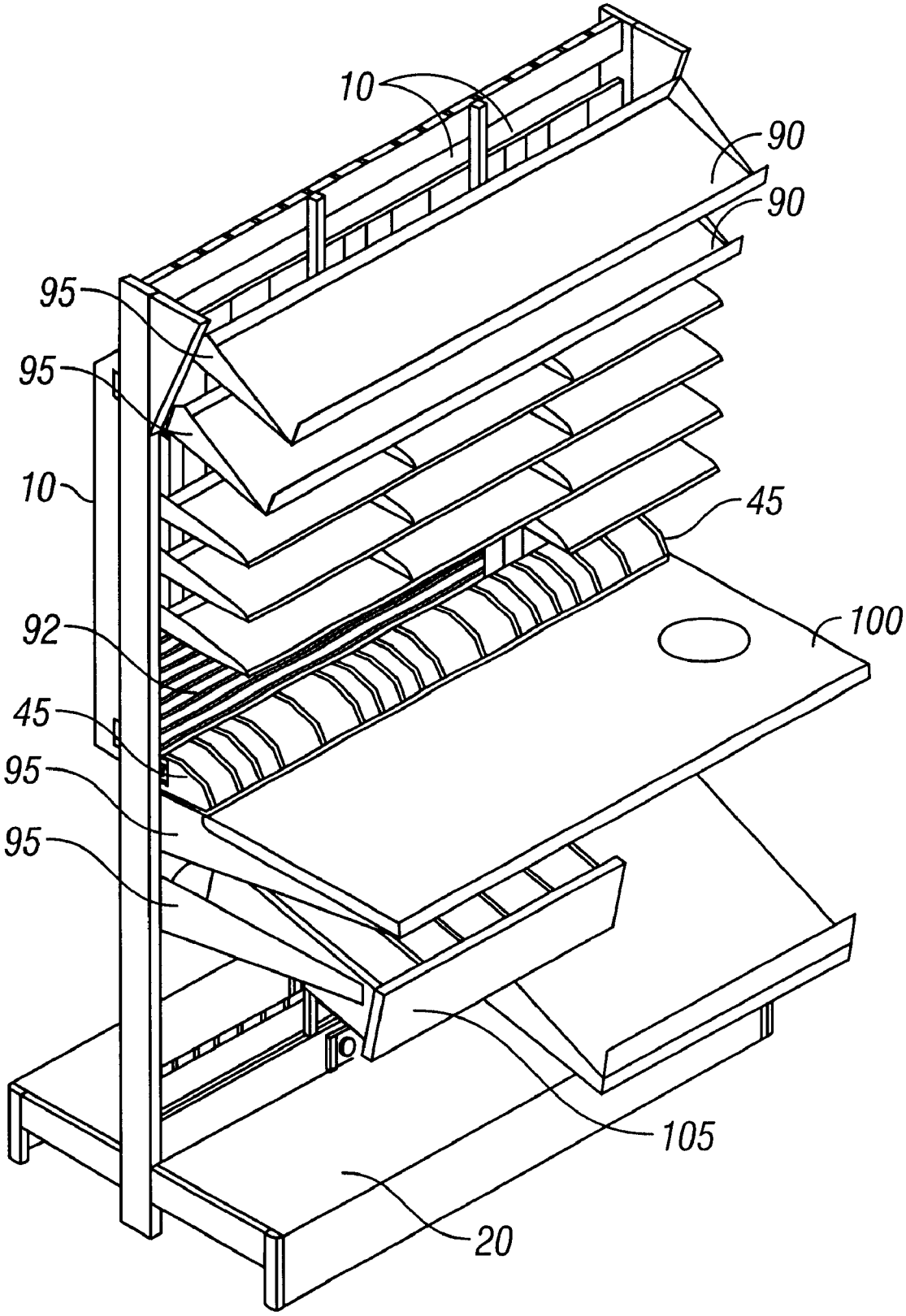
FIG. 10 is a perspective view of another embodiment of the invention.

As shown in FIGS. 1 and 10, conventional brackets 95 can also be used to mount a work surface 100 and a drawer 105 in working relation with, such as below or level with, the dispensing receptacles 45 of the gravity feed dispensers 10.

This configuration creates a workstation in which the dispensers 10 are fully accessible, yet out of the way. And, because the dispensers 10 are located out of the way, the workstation can further include numerous configurations of shelves, drawers, hooks and other fixtures attached to the vertical posts. The invention can thus be configured to form a wide variety of display units and workstations.

For example, the workstation of FIG. 10 is particularly well suited for use in a pharmacy as a workstation for filling prescriptions. Empty vials of various sizes (and their lids) used to hold medicine (not shown) can easily be loaded into the dispensers 10 through the loading openings 61 at the rear of the work-station. Once the vials and lids are loaded into the dispensers 10, they are easily accessed via the dispensing receptacles 45 by a pharmacist working at surface 100. Shelves 90 and drawer 105 provide valuable storage space for medicines, supplies and documents which may be necessary for filling prescriptions. Slat wall 92 provides additional space to support a wide variety of accessories and fixtures, such as, for example, paper and folder trays, pen and pencil holders, telephone holders, and receptacles for other office or pharmacy supplies and equipment. By providing a central and easily accessible location for all the supplies that a pharmacist would need to fill prescriptions, the invention provides an efficient and time-saving pharmacy workstation.

Similarly, various fixtures can be mounted on the support structure 5 and arranged in any number of configurations in relation to the dispensers 10 to create a wide variety of free-standing modular workstations to meet the needs of different applications. In addition to work surface 100, the workstation may include some or all of the fixtures described above, including shelves 90, drawer 105, slat wall 92 and dispensers 10. Mounting work surface 100 to a free-standing modular support structure, like structure 5, provides a work-station that can be used in spaces and locations where it was not convenient to use prior art structures.

While the present invention is described above in connection with specific embodiments, the invention is intended to cover all alternatives, modifications or equivalents that may be included within its sphere and scope, as defined by the appended claims.

What is claimed is:

1. A system comprising:

a support structure having a front and a back;

a fixture extending from the front of the support structure; and a gravity feed dispenser comprising a storage compartment extending between a loading opening and a bottom dispensing receptacle, the gravity feed dispenser being mounted on the front of the support structure and extending rearwardly therefrom such that the fixture is in front of at least a portion of compartment in an overlapping manner.

2. The system of claim 1 wherein the bottom dispensing receptacle is accessible from the front of the support structure.

3. The system of claim 1 further comprising a plurality of side-by-side gravity feed dispensers.

4. The system of claim 1 further comprising a bracket fixed to the dispenser for mounting the dispenser to the front of the support structure.

5. The system of claim 4 wherein the bracket has a side wall projecting away from the front of the support structure.

6. The system of claim 1 wherein the fixture is chosen from a group comprising a shelf, a drawer, a work surface, and a slat wall.

7. A system comprising:

a support structure having a front and a back;

a fixture extending from the front of the support structure;

a gravity feed dispenser comprising a storage compartment extending between a loading opening and a bottom dispensing receptacle, the gravity feed dispenser being mounted on the front of the support structure and extending rearwardly therefrom with the storage compartment disposed behind the support structure such that the fixture is in front of at least a portion of the compartment in an overlapping manner; and a bracket fixed to the gravity feed dispenser for mounting the dispenser to the front of the support structure, wherein the bracket is shaped to engage the front of the support structure and extend rearwardly therefrom for attachment to the gravity feed dispenser behind the front of the support structure.

8. The system of claim 7 wherein the bracket has an engaging surface for engaging the front of the support structure and a side wall extending rearwardly from the front of the support structure for attachment to the dispenser.

9. The system of claim 7 wherein the front of the support structure is provided with at least one mounting slot and the bracket has a tongue for engaging the slot to secure the bracket to the support structure.

10. The system of claim 9 wherein the bracket further comprises a side wall extending rearwardly from the tongue.

11. The system of claim 7 wherein the support structure comprises at least one vertical post and the bracket is shaped to wrap around a portion of the post and extend rearwardly from the front of the post.

12. The system of claim 11 wherein the front of the post is provided with at least one mounting slot and the bracket comprises a tongue for engaging the slot to secure the bracket to the post and a side wall extending rearwardly from the front of the post for attachment to the dispenser.

13. The system of claim 12 wherein a portion of the bracket rests against the front of the post when the bracket is secured to the post, the bracket portion extending between the tongue and the side wall.

14. The system of claim 13 wherein the portion of the bracket extending between the tongue and the side wall is disposed perpendicular to the tongue and the side wall.

* * * * *